United States Patent [19]

Usagawa et al.

[11] 4,368,257

[45] * Jan. 11, 1983

[54] METHOD FOR FORMING A CYAN DYE IMAGE

[75] Inventors: Yasushi Usagawa, Hino; Wataru Fujimatsu, Hachioji; Osamu Sasaki, Hino; Katsumi Matsuura, Hachioji, all of Japan

[73] Assignee: Konishiroku Photo Industry Co., Ltd., Japan

[ * ] Notice: The portion of the term of this patent subsequent to Nov. 10, 1998, has been disclaimed.

[21] Appl. No.: 225,137

[22] Filed: Jan. 14, 1981

[30] Foreign Application Priority Data

Jan. 14, 1980 [JP] Japan ..... 55-2755

[51] Int. Cl.[3] ..... G03C 7/00

[52] U.S. Cl. ..... 430/384; 430/385; 430/552; 430/553; 430/558

[58] Field of Search ..... 430/384, 385, 472, 473, 430/552, 553, 558

[56] References Cited

U.S. PATENT DOCUMENTS

| | | | |
|---|---|---|---|
| 2,801,171 | 7/1957 | Fierke et al. | 430/546 |
| 3,839,044 | 10/1974 | Salminen et al. | 430/553 |
| 4,124,396 | 11/1978 | Osborn | 430/553 |
| 4,299,914 | 11/1981 | Fujimatsu et al. | 430/553 |

*Primary Examiner*—J. Travis Brown

*Attorney, Agent, or Firm*—Finnegan, Henderson, Farabow, Garrett & Dunner

[57] ABSTRACT

A method of forming a cyan dye image by development of an exposed silver halide photographic material with a developer containing a cyan coupler having one of the following formulae:

[I]

-continued

[II]

[III]

wherein $R_1$ is a hydrogen atom or alkyl having 1 to 20 carbon atoms; $R_2$ is alkyl, aryl, or a hetero ring; $R_3$ is hydrogen or halogen; X is arylene or alkylene; Z is a coupling off group; n is 1 or 2;

Q is $Cy\text{-}(R)_m\text{-}SO_2N(A)\text{-}$ or $Cy\text{-}(R)_m\text{-}N(A)SO_2\text{-}$, Q' is $\text{-}N(A)SO_2\text{-}(R')_{m'}\text{-}Cy'\text{-}(Y)_l\text{-}(Cy'')_K\text{-}(R'')_{m''}\text{-}SO_2N(A)\text{-}$ or $\text{-}SO_2N(A)\text{-}(R')_{m'}\text{-}Cy'\text{-}(Y)_l\text{-}(Cy'')_K\text{-}(R'')_{m''}\text{-}N(A)SO_2\text{-}$;

wherein Cy, Cy' and Cy'' are individually a cyclic aliphatic, aromatic or heterocyclic group; R, R' and R'' are individually alkyl; A is hydrogen or a monovalent organic group, Y is a divalent organic group, K, l, m, m' m'' are individually 0 or 1, provided that when m=0, Cy is a cyclic aliphatic or heterocyclic group.

8 Claims, No Drawings

METHOD FOR FORMING A CYAN DYE IMAGE

The present invention relates to a method to form a cyan cye image, particularly to a method form a cyan dye image by color developing a silver halide photosensitive material for color photographic use in the presence of 2,5-diacylamino type cyan coupler. Further, the invention relates to a method to form a cyan dye image in the presence of a cyan coupler, which is better in solubility, despersion stability and spectral absorption characteristics, and has both higher speed of dye forming and greater color density especially when developed in color developing solution having excluded benzyl alcohol, and has, in addition, superior image preserving properties.

As is generally known, aromatic primary amine color developing agent reduces am exposed silver halide grains whereby oxidized product conples woth a coupler. As for cyan couplers to form cyan dyes, the compounds having phenol and naphthol hydroxyl group are used.

As for the fundamental properties to be required for couplers, it is desired to have various characteristics not only that a dye can be simply formed, but also that the solubility to an organic solvent having a high boiling point or to alkali, etc. is greater; that the dispersibility and stability to silver halide photographic emulsions are better and the dyes formed thereby have registance against light, heat, humidity, etc.; that the spectral absorption characteristics are superior; that the transparency is better; that color density is greater; and further that the image obtained is sharper; especially in cyan couplers, it is required to improve the image preserving properties such as heat registance, humidity registance and light registance.

Further, in view of the anti-pollution measure nowadays, it is becoming at a great issue to eliminate benzyl alcohol which is added in color developer. However, it is the status quo in general that the color developability, viz, the dye forming speed and the maximum color density, of coupler added in silver halide photographic emulsion is lowered when used the color developer without adding any benzyl alcohol. And, such tendency will be shown remarkably in case of cyan coupler.

Therefore, it is aspired in such cyan coupler that the color developability will not depend on benzyl alcohol, and the studies for the improvement are being pursued as well as the improvements of said image preserving properties.

There are so far known the following cyan couplers. For instance, the U.S. Pat. No. 2,801,171 discloses 6-[α-(2,4-di-tert-amylphenoxy)butaneamido]-2,4-di-chloro-3-methyl phenol, which has been used commercially in photographic materials extensively and has a excellent characteristics such as light registance, but has a fault in heat registance to which, in addition, dependence on benzgl alcohol in color developability is great, and the maximum color density is not sufficient when developed in color developer eliminated benzyl alcohol therefrom.

And, the coupler described in the U.S. Pat. No. 4,124,396, is the one in which dicarbonylamino group is substituted in place of 2 and 5-positions of phenol, and the publication describes that the dispersion stability at the time of coating or the finish of coating is improved by inducing p-alkylsulfonylaminophenoxy group or p-alkylaminosulfonylphenoxy group into the terminal of the substitutent at 5th position, however as is obvious from the examples to be given hereafter, there is a great dependence upon benzyl alcohol in color developability, therefore some more improvements have to be required at the above problem.

Upon the above, it is an object of the invention to provide a cyan coupler having such desirable characteristics as required for cyan coupler mentioned above.

It is another object of the invention to provide a cyan coupler having superiorities of solubility into alkali or organic solvent with its high boiling point, and dispersibility and stability in silver halide emulsion for color photographic use.

It is further object of the invention to provide a method to form a cyan dye image having a superior image preservabilities, viz, superior registances against heat, light and humidity, and, further having a high speed of dye forming as well as giving a cyan dye image having a great color density when developed in a color developer eliminated benzyl alcohol therefrom.

In the present invention the cyan coupler represented by the following formula [I], [II] or [III], is usable.

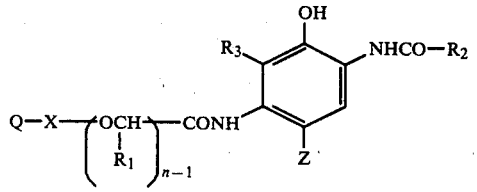

[I]

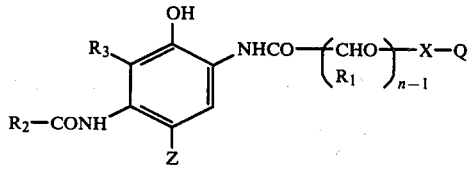

[II]

-continued

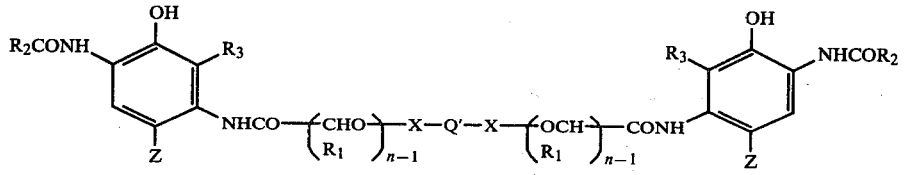

[III]

(Wherein, $R_1$ is hydrogen atom, or alkyl having 1 to 20 numbers of carbon; $R_2$ is alkyl, aryl, or hetero ring; $R_3$ is hydrogen, or halogen; X is arylene or alkylene; Z is coupling off group; and n is 1 or 2.);

Q is $Cy\text{-}(R)_{\overline{m}}SO_2N(A)-$ or $Cy\text{-}(R)_{\overline{m}}N(A)SO_2-$, Q' is $-N(A)SO_2\text{-}(R')_{\overline{m}}Cy'\text{-}(Y)_l\text{-}(Cy'')_{\overline{K}}(R'')_{\overline{m}'}SO_2N(A)-$ or $-SO_2N(A)\text{-}(R')_{\overline{m}'}Cy'\text{-}(Y)_l\text{-}(Cy'')_{\overline{K}}\text{-}(R'')_{\overline{m}'}N(A)SO_2-$;

wherein Cy, Cy' and Cy'' are individually selected from cyclic aliphatic, aromatic or heterocyclic group; R, R' and R'' are individually alkyl; A is hydrogen, or a monovalent organic group, Y is a divalent organic group, K, l, m, m', m'' are individually 0 or 1 with proviso that when m=0, Cy is cyclic aliphatic or heterocyclic group.

In the preferred embodiment of the present invention $R_1$ is hydrogen or alkyl having 1 to 20 numbers of carbon and further as a concrete example of said alkyl group, methyl group, ethyl group, butyl group and dodecyl group or the like are given, for example.

With respect to $R_2$; they include alkyl, e.g. methyl, ethyl, isopropyl, butyl, ter-butyl, dodecyl, pentadecyl, and cyclohexyl; aryl, e.g. phenyl, naphthalene; and hetero ring having exygen, nitrogen or sulfur and 4 to 6 numbered, e.g. furan. Further, $R_2$ may have a substituent whose example includes halogen atom, nitro, hydroxy, carboxy, amino, sulfo, cyano, alkoxy, aryloxy, arylthio, acylamino, carbamoyl, ester, acyl, acyloxy, sulfonamide, sulfamoyl, sulfonyl, sulfoxy oxysulfonyl, etc.

X is preferably, methylene, ethylene or ter-butylene, or phenylene, naphthylene, among these mentioned above, p-phenylene is most preferable, and each of those groups may be substituted with halogen, alkyl (groups such as methyl, ethyl, isobutyl, dodecyl, teramyl, cyclohexyl and pentadecyl) nitro, hydroxy, carboxyl, amino, sulfo, heterocyclic, alkoxy, aryloxy, arylthio, acylamino, carbamoyl, ester, acyl, acyloxy, sulfoneamide, sulfamoyl, sulfonyl and morpholino.

Cy, Cy' and Cy'' are cyclic group and are preferably 3 to 6 membered aliphatic cyclic such as cyclopropyl, cyclobutyl, cyclopentyl, cyclohexyl, cyclooctyl, cyclohexenyl, cyclohexylene, aromatic group such as phenyl, naphthyl and phenylene and 3 to 6 membered heterocyclic containing nitrogen, oxygen or sulfur such as imidazolidinyl, morpholinyl, piperadinyl, pyridyl, quinolyl, etc. As a substituent to be induced in these cyclic groups, halogen atom, nitro, hydroxy, carboxyl, amino, substituted amino, sulfo, alkyl, alkenyl, aryl, hetero cyclic, alkoxy, aryloxy, arylthio, arylazo, acylamino, carbamoyl, ester, acyl, acyloxy, sulfoneamide, sulfamoyl, sufonyl, morpholino etc. are given, for example.

R, R' and R'' in Q and Q' are alkyl group and they may be either of saturated and unsaturated ones and may further be either of the normally chained or the branched chained, and preferably they have 1 to 20 carbon atoms. For example, methylene, ethylene, trimethylene, propylene, dodecamethylene and propenylene group are given. l is preferably 0.

Z is a coupling off group which is well known to the skilled in the art, whose example is hydrogen, halogen, aryloxy carbamolyoxy, carbamoylmethoxy, acyloxy, alkyloxy, sulfonamido, succinimide with which oxygen atom or nitrogen atom is coupled; further concrete examples, which are useful, are given as the described in the U.S. Pat. No. 3,471,563, the Japanese Pat. O.P.I. publication No. 37425/1972, the Japanese Patent Publication No. 36894/1973, the Japanese Patent O.P.I. Publication Nos. 10135/1975, 117422/1975, 130441/1975, 108841/1976, 120334/1975, 18315/1977, 52423/1978, 105226/1978, etc.

As for A, hydrogen, alkyl, aralkyl or phenyl is included as a concrete example.

Next, the following are given as the typical concrete examples of the couplers of the invention.

[I]

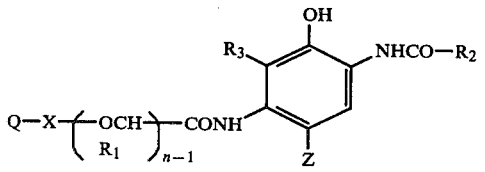

| Coupler No. | Q | X | $R_2$ | $R_3$ | $R_1$ | n | Z |
|---|---|---|---|---|---|---|---|
| 1 | 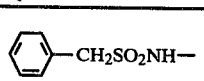 | 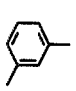 | 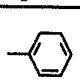 | H | $-C_{12}H_{25}$ | 2 | H |

-continued
| | | | | | | | |
|---|---|---|---|---|---|---|---|
| 2 | 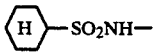 | 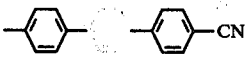 | H | $-C_{14}H_{29}$ | 2 | Cl |
| 3 | 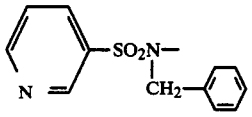 | 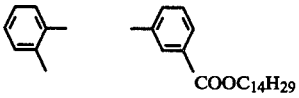 | H | $-C_2H_5$ | 2 | $-OCH_2COOCH_3$ |
| 4 | 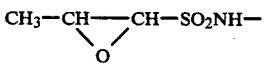 | 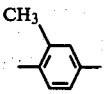 | H | $-C_{12}H_{25}$ | 2 | 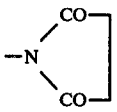 |
| 5 | 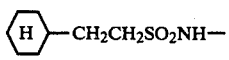 | 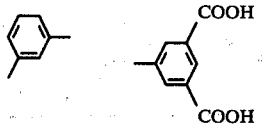 | H | H | 2 | H |
| 6 | 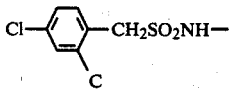 | 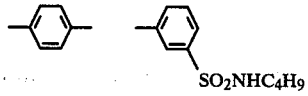 | H | $-C_{12}H_{25}$ | 2 | 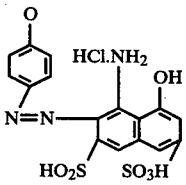 |
| 7 | 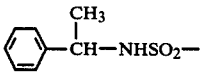 | 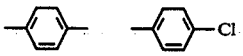 | H | H | 2 | $-OCH-COOH$ (COOH) |
| 8 | 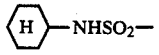 | 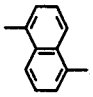 | | $-C_3F_7$ | H | $-C_{14}H_{29}$ 2 H |
[II]
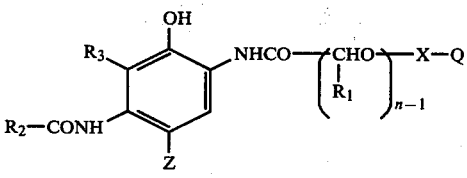
| Coupler No. | Q | X | $R_2$ | $R_3$ | $R_1$ | n | Z |
|---|---|---|---|---|---|---|---|
| 9 | 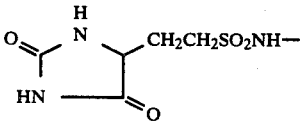 | 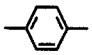 | $-C(CH_3)_3$ | H | $-C_{12}H_{25}$ | 2 | $-NHSO_2-$ 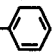 |
| 10 | 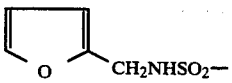 | 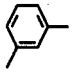 | $-CH-O-$ 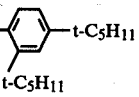 ($C_2H_5$) | H | — | 1 | $-S-$ 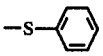 |
| 11 | $C_{18}H_{27}CONH-$ 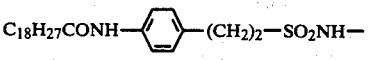 $-(CH_2)_2-SO_2NH-$ | 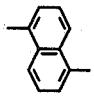 | 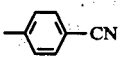 | Cl | H | 2 | Cl |

-continued

| | | | | | | | |
|---|---|---|---|---|---|---|---|
| 12 | 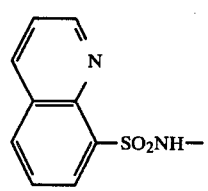 | $\leftarrow CH_2 \rightarrow_3$ | 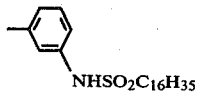 | H | — | 1 | 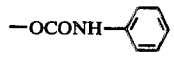 |
| 13 | 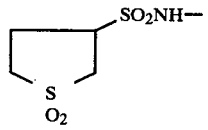 | 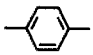 | 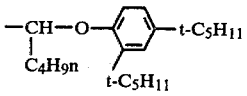 | H | — | 1 | H |
| 14 | 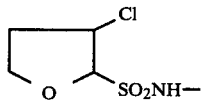 | 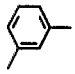 | 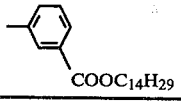 | H | $-C_4H_9$ | 2 | Cl |

[III]

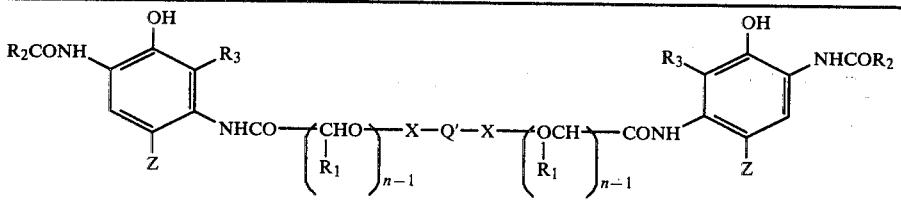

| Coupler No. | Q' | X | $R_2$ | $R_3$ | $R_1$ | n | Z |
|---|---|---|---|---|---|---|---|
| 15 | 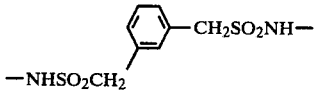 | 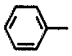 | 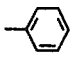 | H | $-C_4H_9$ | 2 | Cl |
| 16 | 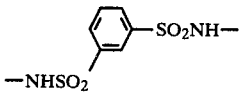 | 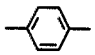 | $-C(CH_3)_3$ | H | $-C_{12}H_{25}$ | 2 | H |
| 17 | 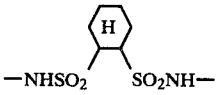 | 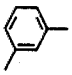 | 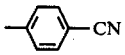 | H | $-C_2H_5$ | 2 | $-OCOOC_2H_5$ |
| 18 | 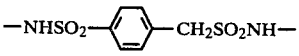 | 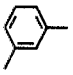 | 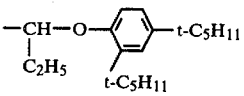 | H | — | 1 | H |
| 19 | 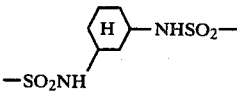 | 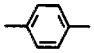 | 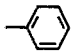 | H | $-C_{12}H_{25}$ | 2 | Cl |
| 20 | 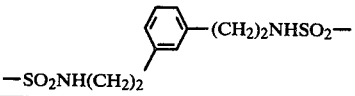 | 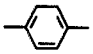 | 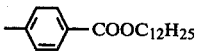 | H | H | 2 | H |

The cyan coupler used in the present invention is easily synthesized for those skilled in the art. U.S. Pat. No. 4,124,396 discloses a similar method for synthesis which may be applicable to the cyan coupler of the present invention.

The following examples are given as the typical synthesis method of the couplers of the invention:

Synthesis Example of Coupler No. 1

(a) Synthesis of ethyl-α-(m-benzylsulfonylaminophenoxy) tetradecanoate (intermediate A).

Ethyl-α-(m-aminophenoxy) tetradecanoate of 7.3 g which had been composed by making use of the method described in the Japanese Pat. O.P.I. Publication No. 109630/1978 and 1.9 g of pyridine were dissolved in 60 ml of tetrahydrofuran and they were stirred together at the room temperature, and then 20 ml of tetrahydrofuran solution of 4.2 g of benzylsulfonylchloride were dropped therein. After dropped in and stirred to make reflux for three hours of time, the mixture reacted was poured in the solution of 200 ml of ice water and 12 ml of hydrochloric acid conc., the extraction was made with ethyl acetate, concentration was then made after washing and drying, and the residual was processed by column method, and 6.2 g (60%) of brown colored oil have been obtained. The constitution thereof has been confirmed by means of NMR.

(b) Synthesis of α-(m-benzylsulfonylaminophenoxy) tetradecanoic acid (intermediate B).

The intermediate A of 5.2 g which had been composed in the example (a) were dissolved in 25 ml of ethanol and then 20 ml of ethanol solution of 2.0 g of potassium hydroxide were added. After making reactions for three hours of time, the mixture reacted was poured in ice water containing 40 ml of IN-HCl, and after extraction was made with ethyl acetate and washing and drying were made, and then 4.9 g (100%) of brown colored oil have been obtained.

(c) Synthesis of α-(m-benzylsulfonylaminophenoxy) tetradecanoic chloride (intermediate C).

The intermediate B of 4.9 g which had been composed in the example (b) were dissolved in 50 ml of benzene and stirred at the room temperature, and 7 ml of thionyl chloride was then added therein. After stirred to make reflux for three hours of time, concentration was made, and 5.1 g (100%) of brown oil have been obtained.

(d) Synthesis of illustrated coupler No. 1

2-benzoylamino-5-aminophenol of 2.3 g were dissolved in 30 ml of ethyl acetate and stirred to make reflux, and then ethyl acetate solution of 5.1 g of the intermediate C, which had been composed in the example (c), were dropped therein. After stirred to make reflux for two hours of time, the mixture reacted was poured in water and organic layer was separated therefrom. After washed and dried, concentration was made, and then brown residue was obtained. The residue was recrystallized from methanol and then 4.2 g (60%) of white powders have been obtained. Melting point thereof was 140°-142° C. Analized value of chemical element

| | C (%) | H (%) | N (%) |
|---|---|---|---|
| Theoretical value | 68.64 | 7.06 | 6.00 |
| Measured value | 68.70 | 7.02 | 6.12 |

The couplers of the invention include the oil-soluble and alkali-soluble of which the oil-soluble couplers are so-called as oil-protect type couplers and may be dissolved in organic solvent having high boiling point and then may be dispersedly contained in the silver halide emulsion. And the alkali-soluble couplers may be dispersedly contained in the color emulsions by applying Fischer's dispersing method, of which examples may be given as the afore described sample coupler [6].

Among couplers of the present invention, oil protect type coupler, for example, may be contained in silver halide emulsion by the conventional method known. For example, after dissolving the coupler of the present invention independently or in combination in individual or in mixed liquid at need of organic solvent with high boiling point of more than 175° C. such as tricresylphosphate and dibutylphthalate etc. and solvent with low boiling point such as butylacetate and butylpropionate etc., it is possible to mix it with aqueous gelatin solution containing surface active agent and to prepare silver halide emulsion to be used for the present invention by adding to silver halide after emulsifying with a high speed rotation mixer or a colloid mill.

Regarding such coupler as that of indeveloper type of the present invention, the coupler having the body structure and split-off group has various application due to the combination thereof. Namely, in case the coupler residual group is the one having the diffusibility in which the water-soluble group such as sulfonic acid group and carbocyclic acid group etc. is substituted, or in case the split-off group itself of the present invention is the one that is diffusible the coupler of the present invention is used as the diffusible coupler, for example, it is used for the photographic technology of so-called coupler in developer type and in that case, the coupler can be used by containing it in the color developing liquid. For example, illustrated coupler [7] may be given.

Further, when the coupler of the present invention is, among the ones having split-off group, the one with the type of non-diffusion with cyan coupler residual group that is non-diffusive and with split-off group that is diffusive, it is suitable to be used for the diffusion transfer process. In order to give diffusibility to each group, the means to select the group with low molecular weight for example and/or to induce the water-soluble group such as aforesaid sulfonic acid group for example, may be used and in order to give condiffusing property to each group, the means to induce long chain aliphatic hydrocarbon residual group and/or to select the relatively high molecular group, may be used.

This diffusion transfer process has an image forming method to utilize cyan dye obtained by the reaction of cyan coupler residual group and color developing agent and an image forming method to utilize the split-off group part that split off when color developing, and an image forming method related to the present invention can be applied to the latter case and the compound obtained with splitting off of the split-off group from the active point of the coupler needs to be diffusive. And in case this split off compound is used, said compound needs to be colored and it is required, for example, that dye portion of azo dye etc. is contained in the compound. This dye portion preferably is the one having water-soluble group and azo dye, azomethine dye, indoaniline dye, indophenol dye and anthraquinon dye etc. are given as the typical one. As the coupler of the present invention that is most suitable to be used for the diffusion transfer process, illustrated coupler [6] is given for example.

As silver halide used for silver halide emulsion that is useable in the present invention, any silver halide to be used for ordinary silver halide emulsion such as silver bromide, silver chloride, silver iodobromide, silver chlorobromide and silver chloroiodobromide etc. are given.

Further, it is possible to make silver halide emulsion of the present invention contain various kinds of known photographic additives.

As a spectral sensitizing dye to be used advantageously in the present invention, cyanine dye, merocyanine dye or compound cyanine dye as described in U.S. Pat. Nos. 2,269,234; 2,270,378; 2,442,710; 2,454,629; 2,776,280 for example, are given.

Color developer that can be used for the present invention is preferably the one containing aromatic primary amine group color developing agent as the principal ingredient. As a concrete example of this color developing agent, the one in p-phenylenediamine group is typical and as an example, diethyl-p-phenylenedianine hydrochloric acid salt and mono-methyl-p-phenylenediamine hydrochloric acid salt, dimethyl-p-phenylenediamine hydrochloric acid salt, 2-amino-5-diethyl-aminotoluene hydrochloric acid salt, 2-amino-5-(N-ethyl-N-dodecylamino)-toluene, 2-amino-5-(N-ethyl-N-β-methanesulfone-amidoethyl)-aminotoluene sulfuric acid salt, 4-(N-ethyl-N-β-methane sulfoneamidoethylamino)aniline, 4-(N-ethyl-N-β-hydroxy ethylamino)aniline and 2-amino-5-(N-ethyl-N- -methoxy-ethyl)aminotoluene etc. are given.

And such color developing agent is used independently or in the mode of combination of more than two kinds thereof or together with black-and-white developing agent such as hydroquinone for example, if necessary. Further, color developer generally contains alkaline agent such as sodium hydroxide, ammonium hydroxide, sodium carbonate, sodium sulfate and sodium sulfite etc. for example and further may contain various kinds of additives such as alkaline metal halide and potassium bromide for example.

In the color developing method to be used for the present invention, color development is made by the ordinary coupler in emulsion type color developing process after the photosensitive material is exposed and this color developer is exceptionally contained in the image receiving material in the diffusion transfer process of certain kind for example and in such technology, it is possible to separate color developing agent from alkaline agent and to process with other liquid containing alkaline agent or color developing agent when developing by using the method wherein alkaline agent alone or color developing agent alone is contained in the image receiving material.

As color developing liquid for the aforesaid coupler in emulsion type, the one with the following composition can be given as a typical example.

| [Composition of color developer] | |
|---|---|
| 4-amino-3-methyl-N—ethyl-N—(methane sulfoneamidoethyl)-aniline sulfuric acid salt | 5.0 g |
| Sodium sulfite (anhydr) | 2.0 g |
| Sodium carbonate (1 hydrate) | 50 g |
| Potassium bromide | 1.0 g |
| Potassium hydroxide | 0.55 g |
| Add water to make | 1 l |

The coupler of the present invention contained in the color emulsion to be used for the present invention reacts with product oxide of color developing agent that is produced when silver halide is developed by such color developer and forms cyan dye.

After the processing of such color development, an ordinary photographic processing such as a pertinent combination of process is selected from the process by the processing liquid such as stop solution containing organic acid, stop/fix solution containing fixing ingredient of organic acid and hypo or ammonium thiosulfate, fixing solution containing fixing ingredient of hypo or ammonium thiosulfate, bleaching liquid containing ferric salt of aminopolycarboxylic acid and alkali halide as a principal ingredient, bleaching and fixing solution containing fixing ingredient of ferric salt of aminopolycarboxylic acid and sodium thiosulfate or ammonium thiosulfate etc. and other stabilizing liquid, and from the process of washing and drying etc., may be done.

Next, a typical concrete example of color developing process wherein the present invention can be used for the process of coupler in emulsion type color negative photosensitive material, will be shown.

| [Process] | |
|---|---|
| Processing step (33° C.) | Processing time |
| Color development | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

Composition of each processing liquid that can be used in the aforesaid process is as follows, for example.

| | |
|---|---|
| [Composition of color developer] | |
| 4-amino-3-methyl-N—ethyl-N—(β-hydroxyethyl)-aniline sulfuric acid salt | 4.8 g |
| Sodium sulfite anhydride | 0.14 g |
| Hydroxylamine, ½ sulfuric acid salt | 1.98 g |
| Sulfuric acid | 0.74 mg |
| Potassium carbonate anhydride | 28.85 g |
| Potassium hydrogen carbonate anhydride | 3.46 g |
| Potassium sulfite anhydride | 5.10 g |
| Potassium bromide | 1.16 g |
| Sodium chloride | 0.14 g |
| Nitrilo acetic acid, 3 sodium salt (1 hydrate) | 1.20 g |
| Potassium hydroxide | 1.48 g |
| Add water to make | 1 l |
| [Composition of bleaching liquid] | |
| Ammonium ferric ethylenediaminetetra acetate | 100 g |
| Ethylenediaminetetra acetic acid 2 ammonium salt | 10 g |
| Ammonium bromide | 150 g |
| Glacial acetic acid | 10 mg |
| Add water to make and adjust to pH 6.0 using aqueous ammonia | 1 l |
| [Composition of fixing liquid] | |
| Ammonia thiosulfate | 175.0 g |
| Sodium sulfite anhydride | 8.6 g |
| Sodium metasulfite | 2.3 g |
| Add water to make and adjust to pH 6.0 using acetic acid | 1 l |
| [Composition of stabilizer] | |
| Formalin (37% water solution) | 1.5 mg |
| Konidacks (made by Konishiroku Photo Ind. Co., Ltd.) | 7.5 mg |
| Add water to make | 1 l |

A typical concrete example of color developing process wherein the present invention can be used for the process of coupler in emulsion type color photographic material, will be shown next.

| [Process] | |
|---|---|
| Processing step (30° C.) | Processing time |
| Color development | 3 min. 30 sec. |
| Bleaching and fixing | 1 min. 30 sec. |
| Washing | 2 min. |
| Stabilizing | 1 min. |

Composition of each processing liquid that can be used in the aforesaid process is as follows for example.

| | |
|---|---|
| [Composition of color developer (1)] | |
| 4-amino-3-methyl-N—ethyl-N—(β-methane sulfoneamidoethyl)-aniline sulfuric acid salt | 5.0 g |
| Sodium hexametaphosphate | 2.5 g |
| Sodium sulfite anhydride | 1.85 g |
| Sodium bromide | 1.4 g |
| Potassium bromide | 0.5 g |
| Borax | 39.1 g |
| Add water to make | 1 l |
| and adjust to pH 10.30 using sodium hydroxide | |
| [Composition of color developer (2)] | |
| 4-amino-3-methyl-N—ethyl-N—(β-methane sulfoneamidoethyl)-aniline sulfuric acid salt | 5.0 g |
| Benzyl alcohol | 15.0 ml |
| Sodium hexametaphosphate | 2.5 g |
| Sodium sulfite anhydride | 1.85 g |
| Sodium bromide | 1.4 g |
| Potassium bromide | 0.5 g |
| Borax | 39.1 g |
| Add water to make | 1 l |
| and adjust to pH 10.30 using sodium hydroxide | |

Aforesaid color developer (1) is a composition of color developer from which benzyl alcohol is not added and color developer (2) is a composition of ordinary color developing liquid to which conventional benzyl alcohol is added. In case the present invention is used for the process of coupler in emulsion type color photographic material, aforesaid color developer (1) and (2) can be used and from the view point of anti-pollution measure, the use of aforesaid color developer (1) is desired and in the present invention, good photographic characteristics are obtained in the use of this desirable color developer (1).

| | |
|---|---|
| [Composition of bleaching and fixing liquid] | |
| Ammonium ferric ethylenediaminetetra acetate | 61.0 g |
| Ethylenediaminetetra acetic acid 2 ammonium salt | 5.0 g |
| Ammonium thiosulfate | 124.5 g |
| Sodium metabisulfite | 13.3 g |
| Sodium sulfite anhydride | 2.7 g |
| Add water to make | 1 l |
| [Composition of stabilizer] | |
| Glacial acetic acid | 20 ml |
| Add water to make | 1 l |

-continued

| | |
|---|---|
| and adjust to pH 3.5–4.0 using sodium acetate | |

The present invention will be explained concretely with an example as follows.

EXAMPLE (1)

Couplers of the present invention as shown in Table 1 and the following comparison couplers [A], [B] and [C] were used and 10 g of each coupler was added to the mixture solution of 2.5 ml of dibutyl phthalate and 20 ml of ethyl acetate and then heated to 60°C. and dissolved. The solution thus obtained was mixed with 5 ml of 10% aqueous solution of alkanol B (alkylnaphthalenesulfonate, made by E. I. Du Pont de Nemours & Co.) and 200 ml of 5% equeous gelatin solution and then was emulsified by the colloid mill and dispersed liquid of each coupler was prepared. then, this coupler dispersed liquid was added to 500 g of gelatin-silver chlorobromide (containing silver bromide of 20 mol) emulsion and was coated no polyethylene coated paper and dried to obtain 6 samples of color photosengraphic material (sample Nos. [1]–[6]). The samples were given a wedge exposure according to the ordinary method and then, was given a color development according to aforesaid color developing process for coupler in emulsion type and cyan color image was obtained. Incidentally, 2 kinds of composition of one with benzyl alcohol added [aforesaid color developer (2)] and the other without benzyl alcohol added [aforesaid color developer (1)] were used as color developer. Photographic characteristics were measured for each of the samples obtained. The results thereof are shown in Table 1.

TABLE 1

| Sample No. | Coupler used | With benzyl alcohol added: Sensitivity | With benzyl alcohol added: Maximum density (Dmax) | Without benzyl alcohol added: Sensitivity | Without benzyl alcohol added: Maximum density (Dmax) | Maximum absorption wavelength (mμ) |
|---|---|---|---|---|---|---|
| 1 | Illustrated (1) coupler | 100 | 2.20 | 80 | 2.05 | 643 |
| 2 | Illustrated (12) coupler | 100 | 2.20 | 83 | 2.21 | 650 |
| 3 | Illustrated (16) coupler | 100 | 2.20 | 84 | 2.20 | 645 |
| 4 | Comparison A coupler | 100 | 2.20 | 55 | 1.52 | 655 |
| 5 | Comparison B coupler | 95 | 1.91 | 60 | 1.55 | 645 |
| 6 | Comparison C coupler | 100 | 1.81 | 50 | 1.54 | 655 |

In the Table, the values of sensitivity are shown as a relative value against the value of 100 that is the sensitivity of sample (4) in case that benzyl alcohol was added wherein comparison coupler [A] is used. The structures of comparison coupler [A], [B] and [C] are as follows.

Comparison coupler [A]

6-[α-(2,4-di-tert-amylphenoxy)butane amide]-2,4-dichloro-3-methylphenol (the one described in aforesaid U.S. Pat. No. 2,801,171)

Comparison coupler [B]

2-benzamide-5-[α-(4-butylsulfonyl-aminophenoxy)tetradecanamide]phenol(the one described in U.S. Pat. No. 4,124,396)

Comparison coupler [C]

6-[α-2,4-di-n-amylphenoxy)butaneamide]-2-chloro-3-methyl-4-(1-phenyl-5-tetrazolyloxy)phenol (the one described in aforesaid U.S. Pat. No. 3,839,044)

As is clear from aforesaid table 1, samples processed with an image forming method of the present invention have a desirable spectral absorption characteristics and further it is noticed that the sensitivity and the maximum density of the color image obtained with color developer having no benzyl alcohol added are greater than any of the comparison couplers [A], [B] and [C].

EXAMPLE (2)

In the same manner as foregoing example (1), 6 samples 7–12 were obtained and light-resisting property, heat-resisting property and humidity-resisting property thereof were checked. Results obtained are shown on Table 2.

TABLE 2

| Sample No. | Coupler used | With benzyl alcohol added | | | Without benzyl alcohol added | | |
|---|---|---|---|---|---|---|---|
| | | Light-resisting property | Heat-resisting property | Humidity-resisting property | Light-resisting property | Heat-resisting property | Humidity resisting property |
| 7 | Illustrated (1) coupler | 80 | 100 | 98 | 81 | 100 | 98 |
| 8 | Illustrated (9) coupler | 92 | 100 | 100 | 91 | 100 | 100 |
| 9 | Illustrated (19) coupler | 91 | 100 | 100 | 92 | 100 | 100 |
| 10 | Comparison A coupler | 91 | 65 | 73 | 90 | 64 | 72 |
| 11 | Comparison B coupler | 72 | 100 | 98 | 71 | 100 | 97 |
| 12 | Comparison C coupler | 91 | 65 | 72 | 90 | 65 | 71 |

In the table, values of light-resisting property represent the residual density of each image after the exposure by a xenon fade meter for 200 hours with the density before the exposure the value of which is 100. Values of humidity-resisting property represent the residual density after the preservation for two weeks under the condition of 60° C. and 80% of relative humidity with the density before the test the value of which is 100. Further, values of heat-resisting property represent the residual density after the preservation for two weeks under the condition of 77° C. with the density before the test the value of which is 100.

As is evident from table 2, comparison couplers [A] and [C] have an excellent capacity in the light-resisting property but they are problematic on the heat-resisting property. The heat-resisting property of the comparison coupler [B] is improved compared with the one for comparison couplers [A] and [C] but the comparison coupler [B] is problematic on the light-resisting property.

On the other hand, in the coupler (1), (9) and (19) concerning the present invention, the effect of the improvement in their light-resisting property is noticed even if they are compared with aforesaid comparison coupler [B].

EXAMPLE (3)

10 g of aforesaid illustrated coupler (8) of the present invention or aforesaid comparison coupler [A], was added to the mixture of 25 ml of dibutylphthalate and 20 ml of ethyl-acetate and was heated up to 60° C. and was completely dissolved. The solution thus obtained was mixed with 5 ml of 10% aqueous solution of alkanol B and 200 ml of 5% aqueous gelatin solution and was emulsified by the colloid mill and dispersion liquid of coupler was prepared. Next, this dispersion liquid was added to 500 g of emulsion of high sensitive gelatin silver iodobromide (containing 6.0 mol% of silver iodide) for the negative and then was coated and dried on the cellulose acetate film base, thus samples 13 and 14 of silver halide photographic photosensitive material having the stable coated film were obtained. This silver halide photographic photosensitive material was exposed in the same manner as example (1) and color developing was conducted according to aforesaid coupler in emulsion type color developing process for color negative and cyan color images were obtained.

Photographic characteristics of cyan color images thus obtained were measured. The results thereof are shown in Table 3.

TABLE 3

| Sample No. | Coupler used | Relative sensitivity | Maximum density (Dmax) | Maximum absorption wavelength (νmax) |
|---|---|---|---|---|
| 13 | Illustrated (8) coupler | 100 | 2.50 | 670 |
| 14 | Comparison A coupler | 54 | 1.54 | 660 |

As is evident from table 3, it is noticed that the sample with the coupler of the present invention used therein has the high maximum density. And the sample of the present invention had cyan negative color images with an excellent transparency.

EXAMPLE (4)

Aforesaid illustrated coupler [6] that is a coupler of the present invention was contained in the ordinary high sensitive silver iodobromide emulsion for the negative by the Fischer dispersion method (0.2 mol amount was used for 1 mol of silver halide), and this emulsion was coated on the triacetate film base by the ordinary method and then dried.

Samples thus obtained were exposed in the same manner as example (1) and then they were processed for 3 minutes at 24° C. with the use of alkaline developer with following composition.

| [Composition of developing liquid] | |
|---|---|
| Sodium sulfite | 20 g |
| 4-N—ethyl-N—β-hydroxyethyl-aminoaniline | 11.0 g |

-continued

| [Composition of developing liquid] | |
|---|---|
| Add water to make | 1 |

At the time of this development, the image receiving layer of the image receiving material wherein the image receiving layer containing dimethyl-β-hydroxyethyl-γ-stearoamidepropylammonium-hydrogenphosphate is provided on the polyethylene-covered paper was contacted with the photosensitive layer of the aforesaid sample and after the development, the image receiving material was peeled off. Thereupon, in the same manner as aforesaid examples (1), (2) and (3), clear cyan positive image with high maximum density and excellent photographic characteristics was obtained on the image receiving material, and it was confirmed that the coupler of the present invention has an excellent property even as a coupler for diffusion transfer process.

EXAMPLE (5)

An illustrated coupler (7) was dissolved in methanol and by adding this, coupler in developer type color developing liquid with following composition was prepared.

| [coupler in developer type color developing liquid] | |
|---|---|
| N,N—diethyl-2-methyl-p-phenylenediamine | 2.0 g |
| Sodium sulfite anhydride | 2.0 g |
| Sodium carbonate (1 hydrate) | 20.0 g |
| Potassium bromide | 1.0 g |
| Illustrated coupler (7) | 2.0 g |
| Add water to make | 1 |

A sample obtained by coating the high sensitive silver iodobromide emulsion onto the subcoated polyethyleneterephthalate film was given an exposure in the ordinary method and then was developed for 3 minutes at 24° C. with aforesaid coupler in developer type color developing liquid.

After the development, washing for 4 minutes, bleaching for 5 minutes, washing for 5 minutes, fixing for 5 minutes, washing for 30 minutes and drying were given successively in the ordinary method, upon which, cyan image with absorption maximum of 665 nm and excellent spectral absorption characteristics and also with excellent other photographic characteristics was obtained.

What is claimed is:

1. A method for forming a cyan dye image comprising developing an imagewisely exposed silver halide emulsion layer coated on a support with an aromatic primary amine developing agent in the presence of a cyan coupler represented by the formula [I], [II] or [III]:

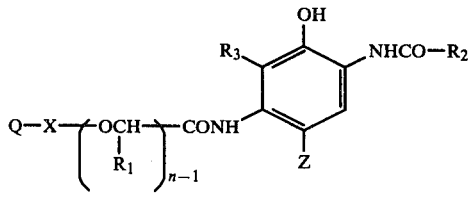

[I]

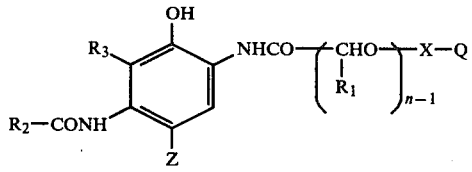

[II]

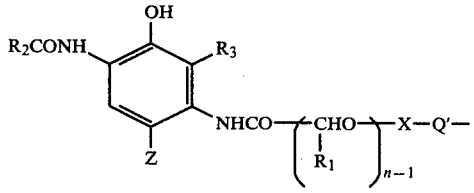

[III]

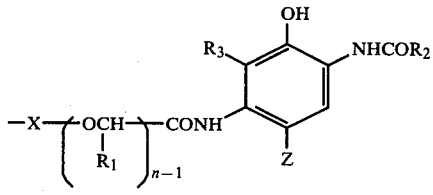

(Wherein, $R_1$ is hydrogen atom, or alkyl having 1 to 20 numbers of carbon; $R_2$ is alkyl, aryl, or hetero ring; $R_3$ is hydrogen, or halogen; X is arylene or alkylene; Z is coupling off group; and n is 1 or 2.);

Q is $Cy(R)_m-SO_2N(A)-$ or $Cy(R)_m-NSO_2(A)-$,

Q' is $-NSO_2(A)-(R')_{m'}-Cy'(Y)_l(Cy'')_k(R'')_{m''}-SO_2N(A)-$ or $-SO_2N(A)-(R')_{m'}-Cy'(Y)_l(Cy'')_k(R'')_{m''}-NSO_2(A)-$;

Wherein Cy, Cy' and Cy'' are individually cyclic aliphatic, aromatic or heterocyclic group; R, R' and R'' are individually alkyl; A is hydrogen, or a monovalent organic group, Y is a divalent organic group, K, l, m, m' m'' are individually 0 or 1 with proviso that when m—0, Cy is cyclic aliphatic or heterocyclic group.

2. A method according to claim 1, wherein Cy, Cy' and Cy'' are individually 3 to 6 membered aliphatic cycle, 3 to 6 membered heterocycle containing nitrogen, oxygen or sulfur, or aromatic group.

3. A method according to claim 1 wherein A is hydrogen.

4. A method according to claim 1 wherein the cyan coupler is one represented by the formula [I] or [II].

5. A method according to claim 4 wherein the cyan coupler is one represented by the formula [I].

6. A method according to claim 5 wherein X is p-phenylene group.

7. A method according to claim 1 wherein the cyan coupler is one represented by the formula [III].

8. A color photographic material having a silver halide emulsion layer containing a cyan coupler coated on a support wherein the cyan coupler is represented by the formula [I], [II] or [III] as shown in the claim 1.

* * * * *